United States Patent [19]

Jansson

[11] 4,027,604

[45] June 7, 1977

[54] MEANS FOR GOVERNING THE AIR SUPPLY TO A FURNACE

[75] Inventor: Stig Jansson, Goteborg, Sweden

[73] Assignee: Gotaverken Angteknik AB, Goteborg, Sweden

[22] Filed: Sept. 29, 1975

[21] Appl. No.: 617,672

[30] Foreign Application Priority Data

Oct. 7, 1974 Sweden ..... 7412568

[52] U.S. Cl. ..... 110/182.5; 122/6.5; 122/235B

[51] Int. Cl.[2] ..... F23L 5/00

[58] Field of Search ..... 110/182.5; 122/235 B; 431/186; 122/6.5

[56] References Cited

UNITED STATES PATENTS

| | | | |
|---|---|---|---|
| 2,696,979 | 12/1954 | Berge | 110/182.5 X |
| 2,831,535 | 4/1958 | Lange | 431/186 |
| 2,966,209 | 12/1960 | Pegrum | 431/186 X |
| 3,742,916 | 7/1973 | Wessberg et al. | 110/182.5 |
| 3,900,011 | 8/1975 | Stenlund | 110/182.5 |

*Primary Examiner*—Kenneth W. Sprague

[57] ABSTRACT

Air governing means at a refuse burning furnace may include a sleeve, which is axially reciprocable with respect to an air passage port in the furnace wall; in order to produce a high air velocity, the air is forced through a narrow, annular clearance between the perimeter of the inward end of the sleeve, and the passage port, the outward end of the sleeve being normally closed; to accommodate for axial mis-alignment at the outward end, the sleeve is adapted to cooperate with a tubular member projecting from the back wall of a plenum chamber supplying the passage port with air; the tubular member is provided with a head displaceable in a plane perpendicular to the longitudinal axis of the tubular member, and further having a tapering front end to facilitate re-introduction into the sleeve, when the latter, in order to perform a scraping function, has performed a stroke exceeding normal governing movement.

4 Claims, 2 Drawing Figures

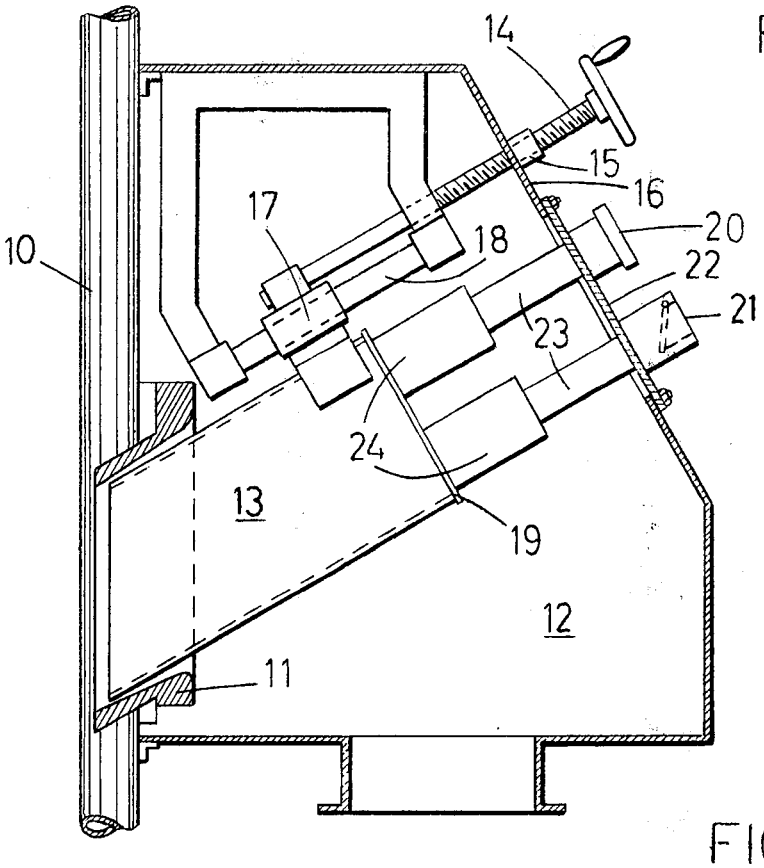
FIG. 1
FIG. 2
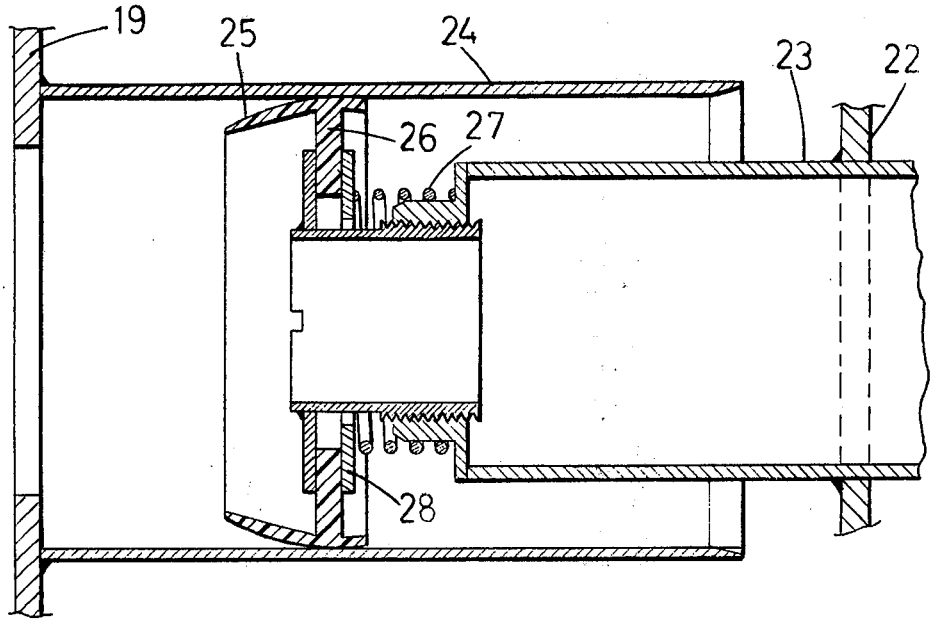

MEANS FOR GOVERNING THE AIR SUPPLY TO A FURNACE

FIELD OF THE INVENTION

This invention relates generally to air governing means of a refuse-burning furnace.

CROSS REFERENCE TO RELATED ART

U.S. Pat. No. 3,875,904 describes air governing means at a refuse burning furnace, which means includes a reciprocable sleeve mounted in such a manner that air is prevented, in use, from passing into the sleeve. There are practical difficulties in ensuring that the sleeve is always moved along the same axis, and it may occasionally be desirable to open the inward end of sleeve.

BACKGROUND OF THE INVENTION

Within certain technical fields, it is desirable in a simple manner to effectively separate two air or gas chambers from each other, where the partition is movable, although not always rectilinearly (not occuring along an axis common both chambers).

Such a need is i.a. evident at those air governing means, which are now being introduced at the recovery furnaces for the cellulose industry, i.e. steam boilers burning waste liquor from the pulping process.

This particular type of fuel, i.e. the waste liquor, tends to clog the passages supplying the combustion air to the furnaces, and of which there is a great number at the furnace, by fused residues (alcali salts), which are flowing down along the walls, or are thrown into the passages by the turbulence of the combustion gases.

The air governing means mentioned above includes an axially displaceable sleeve having a circumference compatible with, but preferably slightly smaller than the basic cross sectional area of the air port. The entrance to such a passage increases in the direction away from the furnace, and the sleeve is hermetically, but resiliently, connected to the outer wall of the plenum chamber supplying the passages with air. By adjusting the axial position of the sleeve so its free end extends more or less into the tapering mouth of the passage, it is possible to determine the effective passage area. The air will thus be forced to flow into the furnace through the annular clearance formed between the sleeve and the air passage port.

This type of governing means can be used for a further purpose; the sleeve may be intermittently pushed inwards, so that it will enter the furnace; in so doing it is possible to remove deposits upon the walls of the passage, whereupon it should be automatically retracted to its governing position.

During this scraping function, it may be advantageous to permit air to pass through the interior of the sleeve, as this will practically close the annular clearance normally surrounding itself. This further provides a safety air supply, should the sleeve be accidentally stuck in the passage. The interior of the sleeve shall thus normally, during the major part of its movement (=the extent of its governing function), be separated from the surrounding plenum chamber. At a certain most forward position, the interior of the sleeve should be made to communicate with the plenum chamber and then be sealed again, when the sleeve is retracted to governing position.

It is evident that this type of equipment cannot be manufactured with any high degree of precision. The sleeve may not move in a path exactly perpendicular to the outer wall of the plenum chamber, even if that was intended. The mechanism used for displacing the sleeve cannot, at reasonable costs, be manufactured with such exactness, that the longitudinal axis of the sleeve will always coincide with the designed longitudinal axis, or even, that the sleeve, after a "scraping stroke", will return along the same axis as the one it started from.

SUMMARY AND OBJECTS OF THE INVENTION

It is then desirable to provide sealing, which, beside the separating function, will also compensate such deviations as mentioned above. The object of the present invention is to provide such a sealing.

This sealing is obtained by forming the sleeve so it, in order to permit access to its interior from outside the plenum chamber, is adapted to telescopically cooperate with a member projecting inwards from the side wall of the plenum chamber, remote from the furnace wall, and entering into the sleeve, or into an extension thereof, said member, at its projecting end being provided with a head, which is mounted so as to be displaceable in a plane perpendicular to the longitudinal axis of the member.

BRIEF DESCRIPTION OF THE DRAWING

FIG. 1 is a section through a plenum chamber and an air port, and

FIG. 2 on a larger scale shows a detail of the telescopic arrangement.

DESCRIPTION OF A PREFERRED EMBODIMENT

FIG. 1 shows a device suitable for use with a recovery furnace, where waste liquor from cellulose pulp is being burnt. The walls of the furnace comprise water-cooled tubes 10. A suitable number of air passage ports are formed in these walls by locally bending two adjacent tubes away from each other. Each passage port is provided with a mouth part 11, having a cross section increasing in the direction away from the furnace. The ports are connected to a plenum chamber 12, located outside the wall. Within this chamber there may be means (not shown) for governing the flow of air to groups of ports.

For individual governing of the air there is, at least at some of the ports 11, a reciprocable sleeve 13. The end portion of this sleeve is compatible with the basic cross section through the port, but has a slightly smaller cross section than that of the port, so an annular clearance will be formed, through which air from the plenum chamber 12 may flow into the furnace. As the entrance to the port will increase in the direction away from the furnace, the axial position of the sleeve with respect to the passage will determine the effective passage area of this clearance.

The sleeve is manipulated by means of a screw 14 working in a nut 15, mounted at the outer wall 16 of the plenum chamber. The screw is connected to the sleeve by way of a guide 17, running along a fixed rod 18, being parallel to the sleeve.

The end of the sleeve 13, remote from the furnace, is closed by a wall 19, so no air will normally pass into the sleeve.

The interior of the sleeve must, however, be accessible from outside the plenum chamber. On the first hand, it is desirable to ocularly inspect the combustion by way of an inspection window 20, and, on the other hand, it is furthermore necessary to be able to introduce lances and other tools into the furnace, through an opening 21 having suitable closure means.

The window and the tool introducing opening are mounted on a lid 22, covering an opening in the plenum chamber wall 16 and each includes a tubular member 23, telescopically cooperating with a tubular extension 24 of the end wall 19 of the sleeve.

There may, of course, be more than two such communication means at each sleeve, but in a simple case, the inspection window may be formed at the means closing the introduction opening. Only one tubular member 23 will then be required and the tubular extension 24 may then be formed by the sleeve 13 itself.

An enlarged longitudinal section through cooperating tubular member and tubular extension is shown in FIG. 2. The tubular member 23 has a noticably smaller diameter than that of the tubular extension 24 and sealing between those two components is brought about by means of a head 25 which has a certain measure in the axial direction of the tubular member 24 and shows, in its major portion, a cross section tapering away from the latter. A longitudinal section through the head will indicate that its envelope surface has a slightly vaulted contour, which means a maintained sealing contact with the surrounding tubular extension, even if the member and the extension should not be exactly coaxial.

The head 25 is provided with an inwardly directed flange 26, located in a plane perpendicular to the longitudinal axis of the member, and being retained at the free end thereof by resilient means including a spring 27 and a washer 28. A limited radial displacement between the head and the washer may occur, without the sealing between the head and the member being destroyed.

It is evident that the head will normally prevent air from entering the sleeve by way of the tubular extension. As mentioned in the introduction it may, however, be suitable, occasionally to remove the sealing function, wholly or partly, when the sleeve, in order to perform its scraping activity in the air port, is brought to its most forward position. In this manner it is possible to obtain an extra amount of air just during this operation, and it is also possible to prevent the air supply through a particular port from being completely cut of, if the pertaining sleeve should be stuck in the port due to high accumulation of deposits.

The stroke of the sleeve should be selected in such a manner that head 25 will, at least partly, be restracted from tubular extension 24, when the sleeve is brought to this most forward position. Due to the tapering shape of the heads there are no difficulties in reintroducing the tubular members into the extensions, when the sleeve is being retracted.

Beside with recovery furnaces, the invention may be utilized with other furnaces, where the fuel burned results in big amounts of combustion residues, and an individual governing of the air supply and a possibility for cleaning the air ports is desirable.

What I claim is:

1. In a device for governing the air supply to a furnace defined by side walls and having a number of air passage ports in at least one of said side walls, a plenum chamber communicating with said air passage ports, said plenum chamber being located outside said side wall, said plenum chamber including a back wall remote from said furnace side wall, at least one sleeve for cooperation with one of said passage ports, said sleeve having an inward end and an outward end, means for axially reciprocating said sleeve move the inward end towards and away from the passage port to adjust an effective air flow passage outside of said sleeve, the improvement of at least one tubular member projecting cantileverwise inwards from the back wall of said plenum chamber, a head at the free end of said tubular member, means for mounting said head at the tubular member so as to permit a displacement of the head in a plane perpendicular to the longitudinal axis of said tubular member, and means at the inward end of said sleeve for sealingly and telescopically receiving said head.

2. The device according to claim 1 in which the last-mentioned means is a tubular extension of the sleeve, proper, an end wall closing the inward end of the sleeve and means for mounting said extension at said end wall in communication with the interior of the sleeve.

3. The device according to claim 1, in which the head is formed with an envelope end surface tapering in the direction away from said tubular member.

4. The device according to claim 1, in which the means for axially reciprocating the sleeve includes means for effecting a stroke, so as to permit said head, in the most forward position of said sleeve, to be at least partly retracted from the receiving means.

* * * * *